US005895317A

United States Patent [19]

Timm

[11] Patent Number: 5,895,317

[45] Date of Patent: Apr. 20, 1999

[54] WHEEL HUB FOR LONGER WHEEL LIFE

[75] Inventor: F. Guy Timm, Harlingen, Tex.

[73] Assignee: Norton Company, Worcester, Mass.

[21] Appl. No.: 08/768,520

[22] Filed: Dec. 18, 1996

[51] Int. Cl.[6] ..... B24B 41/04

[52] U.S. Cl. ..... 451/548; 451/359

[58] Field of Search ..... 451/344, 359, 451/360, 548, 549, 550, 508

[56] References Cited

U.S. PATENT DOCUMENTS

| | | | |
|---|---|---|---|
| 2,149,645 | 3/1939 | Van Sittert | 451/359 |
| 2,259,345 | 10/1941 | Kuzmick et al. | 51/206 |
| 2,308,472 | 1/1943 | Smith | 451/548 |
| 2,726,493 | 12/1955 | Young et al. | 51/168 |
| 3,136,100 | 6/1964 | Robertson, Jr. | 51/209 |
| 3,889,430 | 6/1975 | Scandaletos | 51/206 |
| 4,015,371 | 4/1977 | Grayston | 451/548 |
| 4,088,729 | 5/1978 | Sherman | 264/259 |
| 4,240,230 | 12/1980 | Ferrantini | 51/168 |
| 4,774,788 | 10/1988 | Shacham et al. | 51/168 |
| 4,899,494 | 2/1990 | MacKay, Jr. | 51/168 |
| 4,979,336 | 12/1990 | MacKay, Jr. | 51/168 |
| 5,431,596 | 7/1995 | Akita et al. | 451/540 |
| 5,516,326 | 5/1996 | Virnich | 451/340 |
| 5,538,464 | 7/1996 | MacKay, Jr. | 451/342 |
| 5,718,621 | 2/1998 | Turley | 451/359 |

FOREIGN PATENT DOCUMENTS

| | | | |
|---|---|---|---|
| 709137 | 5/1965 | Canada | 51/195 |

*Primary Examiner*—Eileen P. Morgan
*Attorney, Agent, or Firm*—Mary E. Porter

[57] ABSTRACT

A wheel hub is provided for use in combination with conventional depressed center grinding wheels. The hub includes a generally cylindrical aperture bushing. A disc shaped flange extends radially from a medial portion of the bushing and terminates at a peripheral lip. The bushing is adapted to extend through a central bore of the wheel so that the lip engages the backing face of the wheel proximate an outermost circumference of the depressed center. A grinding face end of the bushing is flangeable radially outward to engage the front grinding face of the wheel and mechanically capture the wheel between the grinding face end and the flange. The flange, lip and backing face form a cavity into which epoxy resin is placed to chemically bond the hub to the wheel. The combination of mechanical fastening and chemical bonding adequately secures the hub to the wheel, nominally without requiring the flange to extend over the stub. The present invention thus advantageously enables the wheel to be ground nominally to the stub, to provide improved wheel utilization.

24 Claims, 1 Drawing Sheet

10
12
13
14
16
18
20
21
22
23
24
25
26
28
29
30
31
32
34
36
a
d
d1
α
β
2
5

WHEEL HUB FOR LONGER WHEEL LIFE

BACKGROUND OF THE INVENTION

1. Field of the Invention

This invention relates to abrasive grinding wheels, and more particularly to an improved wheel hub for mounting a grinding wheel to a grinding apparatus.

2. Background Information

Grinding machines that utilize abrasive grinding wheels mounted therein may be employed to perform many distinct grinding operations. The varied operations have led to the development of a wide variety of grinding wheel shapes and sizes. One type of grinding wheel in particular is the depressed center wheel, characterized by the central portion of the wheel being offset in the axial direction from the wheel periphery. The wheel thus has a concavo-convex stub portion in which a grinding face has a depressed or concave central portion and an opposite backing face has a raised or convex central portion. This design allows a user to perform face grinding operations using the grinding face having the depressed central portion. Often, such operations are performed on metal, masonry or concrete surfaces and the like, using portable grinding machines. Depressed center wheels are classified by the American National Standards Institute (ANSI) as Type 27 and 28 grinding wheels.

The means by which a grinding wheel is secured to the grinding machine spindle is particularly important with depressed center wheels. In general, the mounting means must be capable of holding the wheel perpendicular to the spindle during grinding operations, and must provide support to the wheel to distribute stresses away from the central mounting aperture, where stresses tend to concentrate. The mounting means also must be firmly secured to the abrasive wheel, to prevent any slippage therebetween. In addition, the mounting means for Types 27 and 28 wheels have generally been provided with extra support to the wheel periphery, as well as to the central portion of the backing (non-grinding) face of the wheel to resist the additional stresses imposed by face grinding operations.

To satisfy these requirements, it is common to provide Type 27 and 28 wheels with a hub having a flange that extends over the central raised portion, the concavo-convex stub portion, and onto and in contact with the peripheral portion of the wheel, to resist side pressure or otherwise uneven force applied to the grinding face of the wheel. The opposite face of the wheel is provided with a flange contained completely within the depressed area thereof.

Although such hub construction may produce satisfactory results in many instances, it is not without drawbacks. In particular, extension of the flange beyond the raised stub portion of the backing face tends to limit the useful life of the wheel. In this regard, the wheel must be replaced before it is ground down to the diameter of the backing flange to avoid potentially damaging contact between the backing flange and the workpiece. Accordingly, grinding wheels that utilize this hub construction tend to be discarded with a substantial portion of valuable and otherwise usable abrasive remaining thereon. Such relative under-utilization of the wheel tends to add undesirable expense to grinding operations in terms of both wheel cost and labor costs associated with the frequency of wheel removal and installation.

A need thus exists for an improved grinding wheel hub that overcomes the drawbacks of the prior art.

SUMMARY OF THE INVENTION

According to an embodiment of this invention, a grinding wheel hub is provided for mounting an abrasive grinding wheel on a grinding apparatus. The hub is adapted for use with an abrasive grinding wheel of the type that has a mounting aperture disposed centrally therein, and a grinding face and a backing face disposed on opposite sides of the abrasive grinding wheel. The grinding wheel hub includes an aperture bushing of substantially cylindrical configuration, adapted for extension through and engagement with the surface of the mounting aperture. A grinding face fastener is disposed on the aperture bushing and adapted to extend radially outward from the mounting aperture to engage the grinding face of the wheel. A backing flange of substantially discoid shape, extends radially outward from the aperture bushing member and is adapted for being superposed with the backing face. An annular engagement surface is located along a periphery of the backing flange and is adapted to engage the backing face of the wheel. The backing flange has a bond surface adapted to face the backing face, and is sized and shaped to provide a cavity between the backing flange and the backing face of the grinding wheel when the annular engagement surface is engaged with the backing face. The cavity is adapted to receive a bonding agent therein to bond the grinding wheel hub to the abrasive grinding wheel.

The present invention provides, in a second aspect, a grinding wheel assembly adapted for being mounted on a grinding apparatus. The assembly includes an abrasive grinding wheel having a depressed center, a mounting aperture disposed centrally therein, and a grinding face and a backing face disposed on opposite sides of the abrasive grinding wheel. The assembly also includes a grinding wheel hub of the invention and a mechanical and a chemical bond between the hub and the wheel.

In a third aspect of the present invention, a method is provided for mounting an abrasive grinding wheel on a grinding apparatus, the abrasive grinding wheel having a mounting aperture disposed centrally therein, and a grinding face and a backing face disposed on opposite sides of the abrasive grinding wheel. The method includes providing a grinding wheel hub having an aperture bushing of substantially cylindrical configuration, adapted for extension through and in engagement with the surface of the mounting aperture. A grinding face fastener is placed on the aperture bushing and is adapted to extend radially outward from the mounting aperture to engage the grinding face of the wheel. A backing flange of substantially discoid shape is placed on the aperture bushing member, extending radially outward therefrom, and adapted for being superposed with the backing face. The backing flange is provided with a bond surface adapted to face the backing face. An annular engagement surface is provided along a periphery of the backing flange, and is adapted to engage the backing face of the wheel. A bonding agent is applied to the surface adapted to face the backing face. The aperture bushing is subsequently inserted through and in engagement with the surface of the mounting aperture so that the annular engagement surface is engaged with the backing face of the wheel. The grinding face fastener is then engaged with the grinding face of the wheel so that the wheel is captured between the grinding face fastener and the backing flange, and the bonding agent bonds the grinding wheel hub to the wheel.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figures 1, 2, 3, 4, 5, 6:
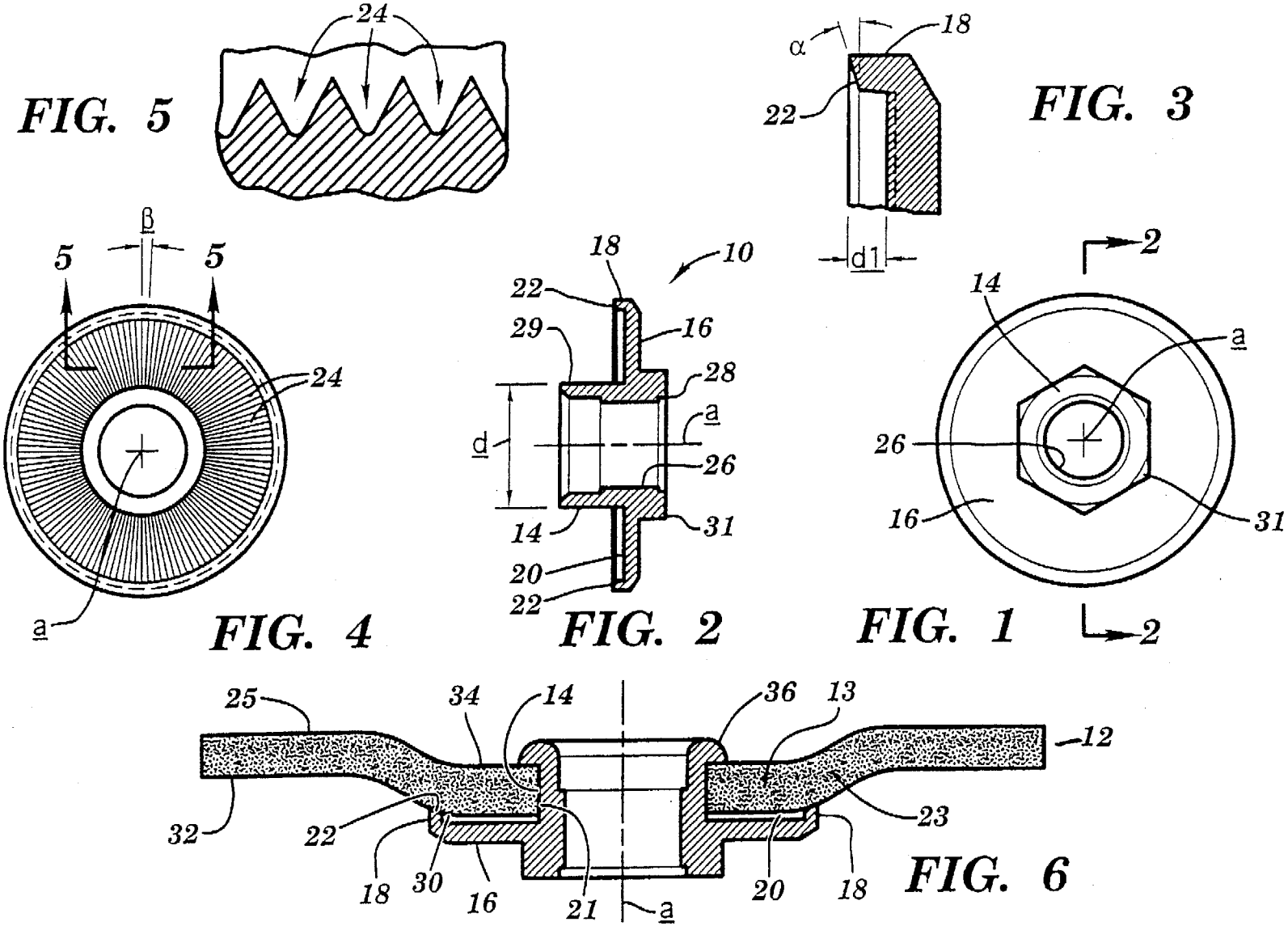
FIG. 1 is a plan view of a wheel hub according to the subject invention.
FIG. 2 is a cross-sectional, elevational view of a wheel hub of the subject invention, taken along 2—2 of FIG. 1.
FIG. 3 is a view similar to that of FIG. 2, of the subject invention on an enlarged scale, with portions broken away and portions thereof shown in phantom.
FIG. 4 is a bottom view of the wheel hub of FIGS. 1 and 2, with portions thereof shown in phantom.
FIG. 5 is an enlarged cross-sectional schematic view taken along 5—5 of FIG. 4, with portions thereof broken away.
FIG. 6 is a view similar to that of FIG. 2, with the wheel hub shown fully installed in a mounting aperture of a grinding wheel.

Briefly described, the invention includes a wheel hub 10 for use in combination with a conventional depressed center grinding wheel 12 (FIG. 6) having a generally flat, depressed center 13, concavo-convex stub portion 23 and nominally flat grinding portion 25. Wheel hub 10 (FIG. 2) includes a generally cylindrical aperture bushing 14. A disc shaped flange 16 extends radially from a medial portion of the bushing and terminates at a peripheral lip 18. Bushing 14 (FIG. 6) is adapted to extend through central bore 21 of wheel 12 so that lip 18 engages backing face 32 of the wheel proximate an outermost circumference of depressed center 13 or the junction of depressed center 13 and stub portion 23 as shown at shoulder 30. A grinding face end 29 (FIG. 2) of bushing 14 is flangeable radially outward to engage front grinding face 34 of wheel 12 and mechanically capture the wheel between grinding face end 29 and flange 16. Flange 16, lip 18 and the backing face 32 form a cavity 20 into which an adhesive, such as epoxy resin, is placed to chemically bond hub 10 to wheel 12.

This combination of mechanical fastening and chemical bonding adequately secures the hub to the wheel without requiring flange 16 to extend over stub 23 and/or onto grinding portion 25. The present invention thus advantageously enables wheel 10 to be ground nominally completely to stub 23, to provide improved wheel utilization relative to the prior art.

For definitional purposes, throughout this disclosure, the terms "axial" and "co-axial" shall refer to a direction substantially parallel to the axis of rotation of wheel hub 10 and/or grinding wheel 12. The terms "transverse" and "radial" shall refer to directions substantially orthogonal to the axial or co-axial direction.

Referring now to the drawings in detail, as shown in FIGS. 1 and 2, aperture bushing 14 is substantially cylindrical, extending from grinding face end 29 to backing face end 28 (FIG. 2). Backing face end 28 is provided with a hex head 31. A central bore 26 extends axially along the length of the bushing. The bushing has a predetermined outer diameter d sufficient to enable grinding face end 29 of bushing 14 to be slidably received within central aperture 21 of grinding wheel 12 (FIG. 6). Central bore 26 and hex head 31 facilitate fastening wheel hub 10 to a conventional grinding apparatus (not shown) in a manner familiar to one skilled in the art.

Disc shaped flange 16 extends radially from a medial portion of bushing 14 and terminates at peripheral lip 18. Lip 18 is generally cylindrical, depending from flange 16 in the axial direction towards grinding face end 29 of the bushing. Lip 18 thus provides flange 16 with a generally concave surface, including cavity 20, that faces grinding face end 29 of bushing 14. Cavity 20 is adapted to receive a bonding agent such as an epoxy resin therein, to chemically bond hub 10 to grinding wheel 12 as will be discussed hereinafter.

Lip 18 terminates at an annular wheel engagement surface 22 adapted to engage backing face 32 of grinding wheel 12. In a preferred embodiment, as shown, surface 22 engages backing face 32 proximate the junction of depressed center 13 and stub portion 23, or shoulder 30, as shown in FIG. 6. As best shown in FIG. 3, an axial cross-section of wheel engagement surface 22 is preferably disposed at a predetermined oblique angle relative to the radial direction. As hub 10, including wheel engagement surface 22, is symmetrical about axis a, angle thus provides surface 22 with a generally frusto-conical configuration. Angle is determined nominally to match the angle curvature of backing face 32 at the point of engagement therewith, as will be discussed in greater detail hereinafter. In a preferred embodiment, as shown, angle is approximately 19 degrees.

The size of wheel engagement surface 22 is predetermined to provide an area of contact between surface 22 and backing face 32, sufficient to nominally prevent leakage of the epoxy resin from cavity 20 once the hub is installed onto wheel 12 as shown in FIG. 6. Moreover, cavity 20 is provided with an axial dimension d1 predetermined to minimize the thickness of the epoxy resin layer disposed therein, while providing sufficient clearance to nominally prevent direct contact between flange 16 and backing face 32. In this regard, dimension d1 preferably varies as a function of the radial distance from aperture bushing 14, wherein dimension d1 is relatively large proximate bushing 14 and decreases progressively towards lip 18. This variation accommodates a need for greater clearance due to burrs or increased wheel thickness proximate central aperture 21, and for lesser clearance towards the edge of depressed center 13 as backing face 32 begins to curve or fair away from flange 16 into concavo-convex stub portion 23.

Referring now to FIGS. 4 and 5, the surface of flange 16 that defines cavity 20 is provided with a series of discontinuities or grooves 24 which serve to increase the surface area of contact with the epoxy resin. In a preferred embodiment, as shown, discontinuities 24 comprise a series of radially extending grooves of substantially V-shaped or saw-tooth cross-section as shown in FIG. 5. The grooves are preferably spaced about the flange at an angular interval of approximately 3 degrees. The increased surface area of contact with the epoxy resin serves to advantageously lower the force per unit area generated between the resin and hub during grinding operations. This serves to effectively increase the overall magnitude of force the hub and wheel combination is capable of withstanding.

Hub 10 may be fabricated from any number of materials capable of providing the requisite structural characteristics, such as, for example, a metallic material or alloy. In a preferred embodiment, hub 10 is fabricated from a steel alloy of relatively high zinc content. An example of a suitable material is a zinc alloy sold under the trademark "Zamac 3" available from Celtic Metal, Inc., Sapula, Okla.

The hub may be formed by any convenient method, including, for example, casting, forging or powder metal forming. In a preferred embodiment, hub 10 is formed by die casting.

Hub 10 is installed onto wheel 12 by filling cavity 20 with a suitable bonding agent such as an epoxy resin as discussed hereinabove. Grinding face end 29 (FIG. 1) of bushing 14 is then inserted into central aperture 21 of wheel 12 until wheel engagement surface 22 engages backing face 32 of the wheel, nominally at shoulder 30 thereof, as shown in FIG. 6. Once so disposed, grinding face end 29, which extends a predetermined distance beyond grinding face 34, is then swaged or flanged in a conventional manner to splay the walls thereof radially outward and form a flange or annular bead 36 as shown in FIG. 6. Bead 36 serves to engage grinding face 34 about the perimeter of central aperture 21 to capture wheel 12 between the bead and flange 16 and thus complete assembly of hub 10 onto wheel 12. Once sufficient time has elapsed to permit the epoxy resin to cure, the hub and wheel assembly may be utilized in a conventional manner in combination with a grinding apparatus.

As shown in FIG. 6 and as discussed hereinabove, the diameter of flange 16, including lip 18, is predetermined to be substantially coextensive with that of depressed center 13 of wheel 12. In this connection, lip 18 nominally extends to shoulder 30 disposed at the junction of depressed center 13 and stub portion 23. In a preferred embodiment as shown, lip 18 is provided with a diameter of approximately 2 inches (5 cm) for use on a conventional 4.5 inch (11.4 cm) diameter ANSI Type 27 wheel. It is also contemplated that a 2 inch (5cm) diameter hub may be utilized in conjunction with a 5 inch (12.7 cm) diameter Type 27 wheel.

In the Type 27 wheel preferred embodiment, the coaxial height of lip 18 is 0.180 inch (0.46 cm), resulting in a cavity 20 for the bonding agent having a coaxial dimension d1 of 0.082 inch (0.21 cm) at the lip 18. The flange 16 used in this embodiment contains grooves 24 to increase the bonding surface area. In an alternate embodiment of the Type 27 wheel, assembled without grooves 24 in the flange 16, the coaxial dimension of the cavity 20 is 0.020 inch (0.05 cm) at lip 18 so as to insure bonding of the flange 16 to the backing face 30 of the wheel 12.

As discussed hereinabove, wheel engagement surface 22 is preferably disposed at an oblique angle of approximately 19 degrees to match the curvature of backing face 32 of a 4.5 inch (11.4 cm) diameter Type 27 wheel at a diameter of approximately 2 inches (5 cm) thereon. In the event the 2 inch (5 cm) hub is utilized in combination with a 5 inch (12.7 cm) diameter Type 27 wheel, angle may be reduced, as required, to facilitate surface to surface engagement of surface 22 with the backing face thereof.

The subject invention thus securely engages wheel 12 with a relatively small overall diameter, nominally without superposing flange 16 over stub portion 23 and/or grinding portion 25. This feature nominally permits grinding of the wheel down to stub 23 without risk of accidental contact of hub 10 with the workpiece. This invention thus permits improved wheel utilization for longer wheel life relative to prior art hub configurations which typically engage the wheel over and radially beyond the concavo-convex or stub portions thereof. In this regard, the present invention has been shown to provide an approximately 10 percent increase in wheel life relative to such prior art wheels.

Although the grinding wheel hub of the subject invention has been shown and described in combination with depressed center grinding wheels, one skilled in the art should recognize that the hub may be utilized in combination with grinding wheels of substantially any configuration, including, but not limited to, conventional cup wheels, dish wheels, recessed wheels, Type 27 and 28 wheels, or any other grinding wheel having a depressed center and a central mounting aperture, without departing from the spirit and scope of the subject invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

I claim:

1. A grinding wheel hub for mounting an abrasive grinding wheel having a depressed center on a grinding apparatus, the abrasive grinding wheel having a grinding face and a backing face disposed on opposite sides of the abrasive grinding wheel, and a substantially flat, depressed center, having a mounting aperture being disposed centrally within the depressed center; said grinding wheel hub comprising:

an aperture bushing of substantially cylindrical configuration, adapted for co-axial extension through and engagement with the surface of the mounting aperture;

a grinding face fastener disposed on said aperture bushing and adapted to engage the grinding face of the wheel;

a backing flange extending substantially radially outward from said aperture bushing member, and adapted for superposed alignment with the backing face;

an annular engagement surface disposed along a periphery of said backing flange, and adapted to engage the backing face of the wheel;

wherein said backing flange has a substantially concave surface adapted to face the backing face; and said annular engagement surface is adapted to engage the backing face of the wheel proximate an outermost circumference of the depressed center of the wheel.

2. The grinding wheel hub as set forth in claim 1, wherein:

the backing flange has a bond surface adapted to face the backing face; and said bond surface is sized and shaped to provide a cavity between said backing flange and the backing face of the grinding wheel when said annular engagement surface is engaged with the backing face, the cavity being adapted for receipt of a bonding agent therein to bond said grinding wheel hub to the abrasive grinding wheel.

3. The grinding wheel hub as set forth in claim 1, wherein said grinding face fastener comprises a grinding face end of said aperture bushing, said grinding face end adapted for being flanged radially outward from the mounting aperture to engage the grinding face.

4. The grinding wheel hub as set forth in claim 1, further comprising a peripheral lip depending substantially axially from a terminal circumference of said flange, said peripheral lip terminating at said annular engagement surface.

5. The grinding wheel hub as set forth in claim 4, wherein said backing flange and said peripheral lip define said substantially concave surface.

6. The grinding wheel hub as set forth in claim 5, wherein the cavity is defined by said aperture bushing member, said backing flange and said peripheral lip, in combination with the backing face of the abrasive grinding wheel.

7. The grinding wheel hub as set forth in claim 2, wherein adhesive is disposed within the cavity to bond the grinding wheel hub to the abrasive grinding wheel.

8. The grinding wheel hub as set forth in claim 2, wherein said flange further comprises a plurality of surface irregularities adapted to provide a textured surface area for engagement with the adhesive.

9. The grinding wheel hub as set forth in claim 8, wherein said plurality of surface irregularities comprises a plurality of grooves extending radially from said aperture.

10. The grinding wheel hub as set forth in claim 1, wherein said annular engagement surface is adapted for surface to surface engagement with the backing face.

11. The grinding wheel hub as set forth in claim 10, wherein said annular engagement surface, in an axial cross-section thereof, is disposed at an oblique angle relative the co-axial direction, said annular engagement surface being adapted for superimposed engagement with a portion of the backing face.

12. The grinding wheel hub as set forth in claim 11, wherein said annular engagement surface is disposed at an approximately 19 degree angle relative the co-axial direction.

13. The grinding wheel hub as set forth in claim 12, wherein the abrasive grinding wheel includes a substantially discoid depressed center that fairs in a radially outward direction into a substantially concavo-convex stub portion, the generally concavo-convex stub portion fairing radially outward therefrom into a grinding portion, said annular engagement surface being adapted to engage the backing face of the abrasive grinding wheel proximate the fairing of the depressed center into the concavo-convex stub portion.

14. The grinding wheel hub as set forth in claim 13, wherein the abrasive grinding wheel comprises an ANSI Type 27 wheel.

15. The grinding wheel hub of claim 7, wherein the adhesive is an epoxy resin.

16. A grinding wheel assembly adapted for being mounted on a grinding apparatus, comprising;

an abrasive grinding wheel having a depressed center and a mounting aperture disposed centrally therein, and a grinding face and a backing face disposed on opposite sides of the abrasive grinding wheel;

the grinding wheel hub of claim 1; and a bonding agent between the backing face and the wheel hub.

17. A method of mounting an abrasive grinding wheel on a grinding apparatus, the abrasive grinding wheel having a substantially flat, depressed center, a mounting aperture disposed centrally within the depressed center, and a grinding face and a backing face disposed on opposite sides of the abrasive grinding wheel, said method comprising:

providing a grinding wheel hub having an aperture bushing of substantially cylindrical configuration, adapted for co-axial extension through and engagement with the surface of the mounting aperture;

inserting the aperture bushing through and in engagement with the surface of the mounting aperture;

fabricating a grinding face fastener on the aperture bushing by flanging an end of the aperature bushing to engage a portion of the grinding face of the wheel within the depressed center of the wheel;

applying a bonding agent to a substantially concave bond surface of a backing flange adapted to receive the bonding agent therein, the backing flange having a substantially discoid shape and an annular engagement surface along an outermost circumference of said backing flange, and the bond surface being adapted for superposed alignment with the backing face of the abrasive wheel;

disposing the backing flange on the aperature bushing to engage the annular engagement surface with the backing face of the wheel, the annular engagement surface being adapted to engage the backing face of the wheel proximate a periphery of the depressed center of the wheel;

wherein the wheel is captured between the grinding face fastener and the backing flange, and the bonding agent bonds the backing flange of the grinding wheel hub to the backing face of the wheel.

18. The method as set forth in claim 17, wherein said step of providing the backing flange with a concave surface further comprises the steps of providing a peripheral lip depending substantially axially from a terminal circumference of said flange and terminating the peripheral lip at the annular engagement surface.

19. The method as set forth in claim 17, wherein the bonding agent comprises an epoxy resin.

20. The method as set forth in claim 17, further comprising the step of providing the concave surface with a plurality of surface irregularities adapted to provide a textured surface area for engagement with the bonding agent.

21. The method as set forth in claim 19, wherein said plurality of surface irregularities comprises a plurality of grooves extending radially from said aperture.

22. The method as set forth in claim 17, wherein the annular engagement surface is in superimposed engagement with a portion of the backing face.

23. The method as set forth in claim 22, wherein said annular engagement surface, in an axial cross-section, is disposed at an oblique angle relative the axial direction of said hub, said annular engagement surface being adapted for superimposed engagement with a portion of the backing face disposed at an oblique angle relative the axial direction of the abrasive grinding wheel.

24. A grinding wheel hub for mounting an abrasive grinding wheel on a grinding apparatus, the abrasive grinding wheel having a substantially flat, depressed center, a mounting aperture disposed centrally within the depressed center, and a grinding face and a backing face disposed on opposite sides of the abrasive grinding wheel, said grinding wheel hub comprising:

an aperture bushing of substantially cylindrical configuration, adapted for co-axial extension through and engagement with the surface of the mounting aperture;

a grinding face fastener disposed on said aperture bushing and adapted to engage the grinding face of the wheel;

a backing flange of substantially discoid shape extending radially outward from said aperture bushing member, and adapted for superposed alignment with the backing face;

said backing flange having a substantially concave surface adapted to face the backing face;

an annular engagement surface disposed along a periphery of said backing flange and adapted to engage the backing face of the wheel proximate an outermost circumference of the depressed center;

wherein said substantially concave surface of said flange provides a cavity between said backing flange and the backing face of the grinding wheel when said annular engagement surface is engaged with the backing face, the cavity adapted for receipt of a bonding agent therein to bond said grinding wheel hub to the abrasive grinding wheel.

* * * * *